US011802499B2

(12) United States Patent
Boehlke

(10) Patent No.: US 11,802,499 B2
(45) Date of Patent: Oct. 31, 2023

(54) EXHAUST SYSTEM TUNER TUBE TO REDUCE STANDING WAVE

(71) Applicant: Tenneco Automotive Operating Company Inc., Lake Forest, IL (US)

(72) Inventor: Boyd Boehlke, Horton, MI (US)

(73) Assignee: Tenneco Automotive Operating Company Inc., Northville, MI (US)

( * ) Notice: Subject to any disclaimer, the term of this patent is extended or adjusted under 35 U.S.C. 154(b) by 107 days.

(21) Appl. No.: 17/533,946

(22) Filed: Nov. 23, 2021

(65) Prior Publication Data

US 2023/0160325 A1 May 25, 2023

(51) Int. Cl.

| | |
|---|---|
| ***F01N 1/02*** | (2006.01) |
| ***G10K 11/16*** | (2006.01) |
| ***F01N 1/08*** | (2006.01) |
| ***G10K 11/172*** | (2006.01) |

(52) U.S. Cl.

CPC ..... *F01N 1/02* (2013.01); *F01N 1/08* (2013.01); *G10K 11/161* (2013.01); *G10K 11/172* (2013.01); *F01N 2490/08* (2013.01); *F01N 2490/15* (2013.01)

(58) Field of Classification Search

CPC ..... F01N 1/023; F01N 1/161; F01N 1/163; F01N 1/166; F01N 2240/36

See application file for complete search history.

(56) References Cited

U.S. PATENT DOCUMENTS

| | | | | |
|---|---|---|---|---|
| 3,703,937 | A * | 11/1972 | Tenney | F02B 27/06 60/314 |
| 7,506,723 | B2 | 3/2009 | Hoerr et al. | |
| 8,397,863 | B2 * | 3/2013 | Paze' | F01N 1/166 181/254 |
| 10,584,626 | B2 | 3/2020 | Herwat et al. | |
| 10,596,898 | B2 | 3/2020 | Herwat et al. | |
| 2015/0354421 | A1 * | 12/2015 | Hörr | F01N 1/166 181/241 |
| 2019/0323396 | A1 | 10/2019 | Ronnmark et al. | |

* cited by examiner

*Primary Examiner* — Jonathan R Matthias

(74) *Attorney, Agent, or Firm* — Harness, Dickey & Pierce, P.L.C.

(57) ABSTRACT

A muffler assembly for an exhaust system is in fluid communication with a collector via an exhaust conduit. The muffler assembly includes a primary pipe, a valve, a secondary pipe, a tuner tube and a bleed port. The primary pipe extends through an enclosed volume of the muffler. The valve is operable to restrict flow through the primary pipe. When a standing wave is present, a resonance length is defined by a length of the exhaust system that extends from the collector to the valve. The tuner tube includes an open tuner tube end in fluid communication with the primary pipe and a closed tuner tube end. The tuner tube has a tuner tube length that is substantially one-quarter of the resonance length. The bleed port is formed in the primary pipe, allowing fluid communication with the enclosed volume, and positioned downstream from open tuner tube end.

14 Claims, 6 Drawing Sheets

EXHAUST SYSTEM TUNER TUBE TO REDUCE STANDING WAVE

FIELD

The present disclosure relates to an exhaust system for a vehicle engine emitting exhaust gas, and particularly to an exhaust system with a tuner tube to reduce a standing wave.

BACKGROUND

This section provides background information related to the present disclosure which is not necessarily prior art.

An internal combustion engine can generate a substantial amount of combustion noise, which is transferred through an exhaust system and is audible as tailpipe noise. Mufflers are used within exhaust systems to reduce this noise and/or tune the exhaust sound characteristics to desired sound qualities. An electronic exhaust valve may be implemented within the exhaust system to control flow through a primary pipe of the muffler. The exhaust system may exhibit a drone or standing wave in the exhaust system when the electronic exhaust valve is closed, but no standing wave is created when the electronic exhaust valve is open. The present disclosure provides a tuner tube connected to the primary pipe to attenuate the standing wave.

SUMMARY

This section provides a general summary of the disclosure, and is not a comprehensive disclosure of its full scope or all of its features.

In accordance with one aspect of the present disclosure, a muffler assembly for an exhaust system for a vehicle engine emitting exhaust gas is provided. The exhaust system includes a collector and an exhaust conduit providing exhaust gas to the muffler assembly. The muffler assembly includes a housing, a primary pipe, a valve, a resonance length, a secondary pipe, a tuner tube, and a bleed port. The housing defines an enclosed volume. The primary pipe includes a primary pipe inlet and a primary pipe outlet. The primary pipe extends through the enclosed volume of the muffler. The valve is operable to restrict flow through the primary pipe. The resonance length is defined by a length of the exhaust system that extends from the collector of the vehicle engine to the valve. The secondary pipe includes a secondary pipe inlet and a secondary pipe outlet. The secondary pipe inlet is positioned in fluid communication with the enclosed volume. The secondary pipe outlet is positioned outside of the enclosed volume. The tuner tube includes an open tuner tube end and a closed tuner tube end. The open tuner tube end is in fluid communication with the primary pipe. The closed tuner tube end is opposite to the open tuner tube end. The tuner tube has a tuner tube length substantially one quarter of the resonance length. A bleed port is formed in the primary pipe and is in fluid communication with the enclosed volume. The bleed port is positioned downstream from the open tuner tube end.

In some configurations of the muffler assembly of the above paragraph, the muffler assembly includes a first baffle and a second baffle. The first baffle cooperates with the housing to define a first chamber. The second baffle cooperates with the housing to define a third chamber. A second chamber is positioned between the first and second baffle. Each of the first and second baffles including at least one perforation allowing the second chamber to be in fluid communication with the first chamber and the third chamber.

In some configurations of the muffler assembly of any one or more of the above paragraphs, the tuner tube is positioned within the first and second chambers.

In some configurations of the muffler assembly of any one or more of the above paragraphs, the bleed port is positioned within the first chamber.

In some configurations of the muffler assembly of any one or more of the above paragraphs, the secondary pipe inlet is positioned within the third chamber.

In some configurations of the muffler assembly of any one or more of the above paragraphs, at least one baffle is disposed within the housing and cooperating with the housing to define a plurality of chambers within the housing. The at least one baffle includes at least one perforation allowing fluid communication between adjacent chambers.

In some configurations of the muffler assembly of any one or more of the above paragraphs, the open tuner tube end is spaced from the collector at a distance of about 0% to about 10% of the resonance length.

In some configurations of the muffler assembly of any one or more of the above paragraphs, the open tuner tube end is spaced from the valve at a distance of about 0% to about 10% of the resonance length.

In some configurations of the muffler assembly of any one or more of the above paragraphs, the muffler assembly includes a bleed tube. The bleed tube includes a first bleed tube end in fluid communication with the primary pipe and a second bleed tube end. The bleed port is disposed at the second bleed tube end.

In some configurations of the muffler assembly of any one or more of the above paragraphs, the bleed port is at least one perforation.

The present disclosure also provides a muffler assembly that includes a housing, a primary pipe, a first valve, a first resonance length, a secondary pipe, a tertiary pipe, a first tuner tube, and a first bleed port. The housing defines an enclosed volume. The primary pipe includes a primary pipe inlet and a primary pipe outlet. The primary pipe extends through the enclosed volume. The first valve is operable to restrict flow through the primary pipe. The first resonance length is defined by a length of the exhaust system that extends from the collector of the vehicle engine to the valve. The secondary pipe includes a secondary pipe inlet and a secondary pipe outlet. The secondary pipe inlet is positioned in fluid communication with the enclosed volume. The secondary pipe outlet is positioned outside of the enclosed volume. The tertiary pipe includes a tertiary pipe inlet and a tertiary pipe outlet. The tertiary pipe extending through the enclosed volume. The first tuner tube includes an open first tuner tube end in fluid communication with the primary pipe and a closed first tuner tube end that is opposite the open tuner tube end. The first tuner tube has a first tuner tube length of substantially one-quarter of the first resonance length. The first bleed port is formed in the primary pipe and is in fluid communication with the enclosed volume. The first bleed port is positioned downstream from the open first tuner tube end.

In some configurations of the muffler assembly of any one or more of the above paragraphs, the muffler assembly further includes a second valve, a second resonance length, a second tuner tube, and a second bleed port. The second valve is operable to restrict flow through the tertiary pipe. The second resonance length is defined by a length of the exhaust system that extends from the collector of the vehicle engine to the second valve. The second tuner tube includes an open second tuner tube end that is in fluid communication with the tertiary pipe and a closed second tuner tube end that is opposite the open second tuner tube end. The second tuner tube has a second tuner tube length of substantially one-quarter of the second resonance length. The second bleed port is formed in the tertiary pipe tube and is in fluid communication with the enclosed volume. The second bleed port is positioned downstream from the open second tuner tube end.

In some configurations of the muffler assembly of any one or more of the above paragraphs, the muffler assembly further includes a quaternary pipe. The quaternary pipe includes a quaternary pipe inlet positioned in fluid communication with the enclosed volume and a quaternary pipe outlet positioned outside of the enclosed volume.

In some configurations of the muffler assembly of any one or more of the above paragraphs, a third distance between the tertiary pipe inlet and second bleed port is greater than a fourth distance between the tertiary pipe inlet and the open second tuner tube end.

In some configurations of the muffler assembly of any one or more of the above paragraphs, a first distance between the primary pipe inlet and the first bleed port is greater than a second distance between the primary pipe inlet and the open first tuner tube end.

In some configurations of the muffler assembly of any one or more of the above paragraphs, the muffler assembly further a first baffle and a second baffle. The first baffle cooperates with the housing to define a first chamber. The second baffle cooperates with the housing to define a third chamber. A second chamber is positioned between the first and second baffles. Each of the first and second baffles includes at least one perforation, allowing the second chamber to be in fluid communication with the first chamber and the third chamber.

The present disclosure also provides a muffler assembly that includes a housing, a first baffle, a second baffle, a primary pipe, a valve, a resonance length, a secondary pipe, a tuner tube, and a bleed port. The housing defines an enclosed volume. The first baffle cooperates with the housing to define a first chamber. The second baffle cooperates with the housing to define a third chamber. A second chamber is positioned between the first and second baffles. Each of the first and second baffles includes at least one perforation, allowing the second chamber to be in fluid communication with the first chamber and the third chamber. The primary pipe includes a primary pipe inlet and a primary pipe outlet. The primary pipe extends through the enclosed volume. The valve is operable to restrict flow through the primary pipe. The resonance length is defined by a length of the exhaust system that extends from the collector of the vehicle engine to the valve. The secondary pipe includes a secondary pipe inlet positioned in fluid communication with the enclosed volume and a secondary pipe outlet positioned outside of the enclosed volume. The tuner tube includes an open tuner tube end in fluid communication with the primary pipe and a closed tuner tube end that is opposite the open tuner tube end. The tuner tube has a tuner tube length of substantially one-quarter of the resonance length. The bleed port is formed in the primary pipe and is in fluid communication with the enclosed volume. The bleed port is positioned downstream from the open tuner tube end.

In some configurations of the muffler assembly of any one or more of the above paragraphs, the open tuner tube end is positioned in the first chamber and the closed tuner tube end is positioned in the second chamber.

In some configurations of the muffler assembly of any one or more of the above paragraphs, the valve is positioned within the enclosed volume.

In some configurations of the muffler assembly of any one or more of the above paragraphs, the valve is positioned outside of the enclosed volume.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
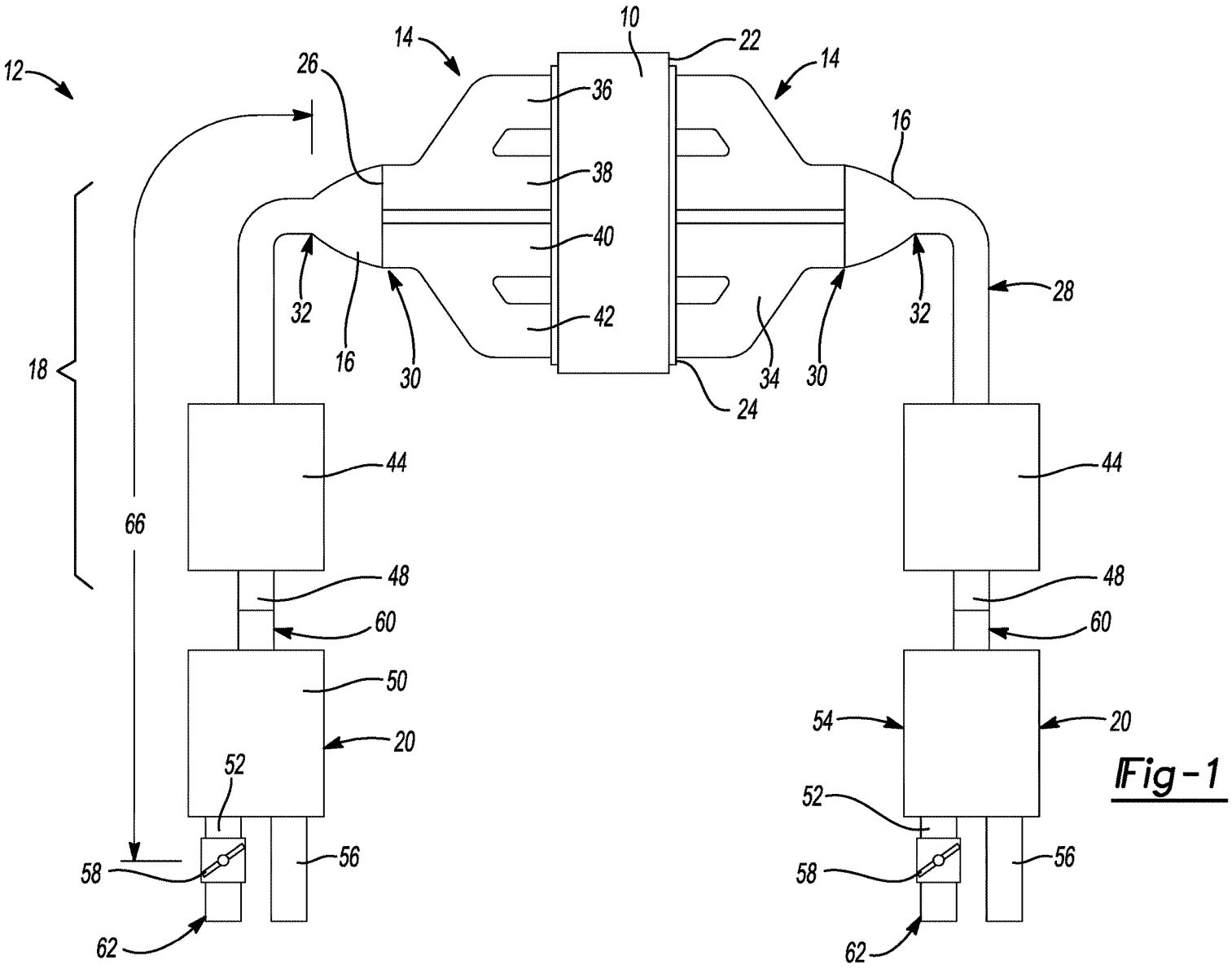
FIG. 1 is a schematic representation of a vehicle engine and exhaust system having a muffler assembly according to the principles of the present disclosure.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
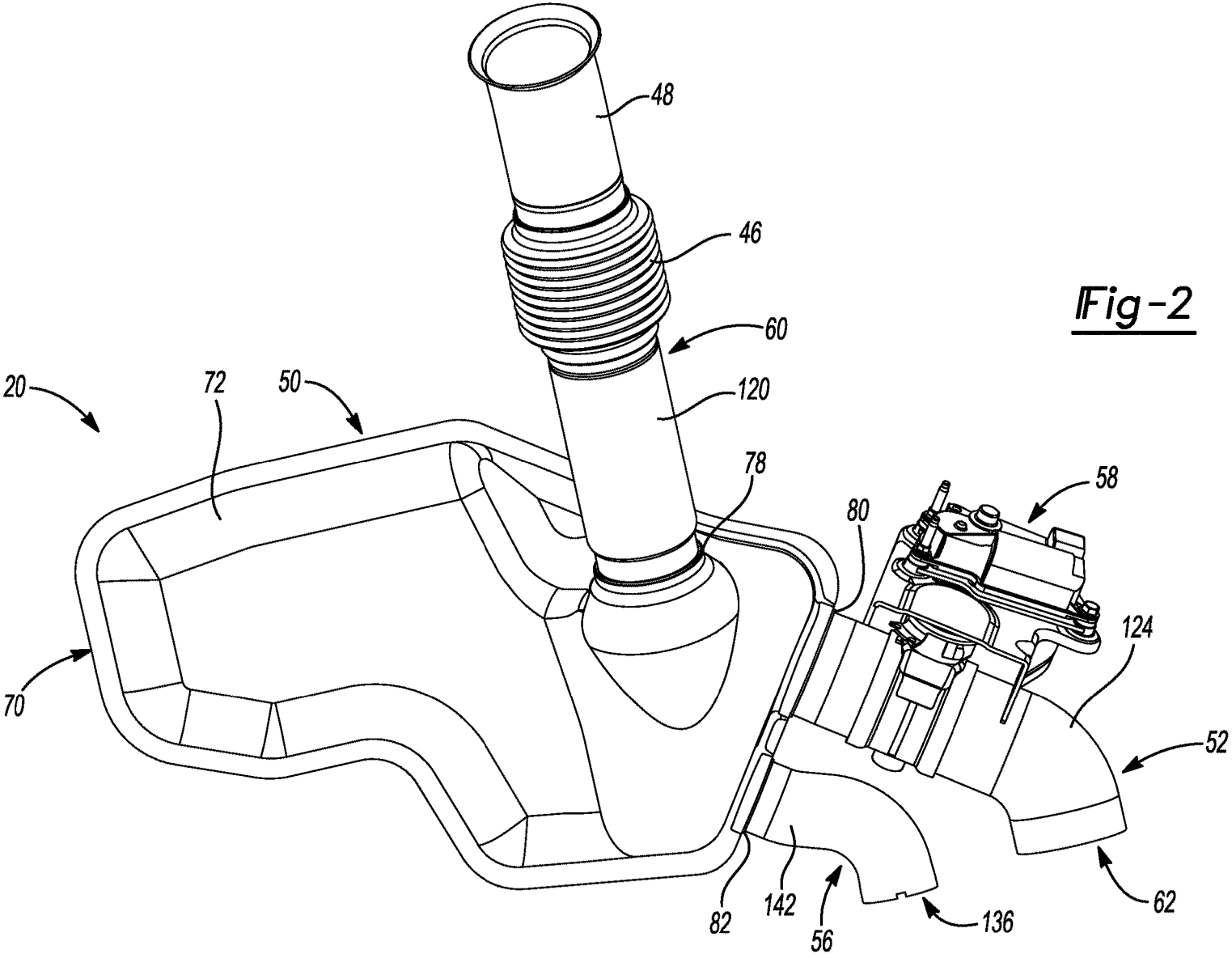
FIG. 2 is a front view of the exemplary muffler assembly.

With reference to FIGS. 1 and 2, a vehicle engine 10 is provided and operable to emit exhaust gas into an exhaust system 12. The vehicle engine 10 may include a first bank of cylinders and a second bank of cylinders positioned opposite from the first bank of cylinders. In-line cylinder configurations are also common.

The exhaust system 12 may include one or more exhaust manifolds 14, collectors 16, exhaust conduits 18, and muffler assemblies 20. Typically, one exhaust manifold 14 is mounted to the vehicle engine 10 in fluid communication with either of the first or second bank of cylinders. The exhaust manifold may extend between a mounting surface 22 or a mounting flange 24 and an exhaust manifold outlet end 26. The collector 16 may be integrally formed with the exhaust manifold 14 at the exhaust manifold outlet end 26 or may be a separate component disposed at the exhaust manifold outlet end 26. The collector 16 is the portion of the exhaust system 12 that merges the flow from each individual cylinder of the vehicle engine 10 into an exhaust passageway 28 of the exhaust conduit 18. The collector 16 may extend between a collector inlet 30 and a collector outlet 32.

More specifically, each exhaust manifold 14 may include a branch 34 associated with each cylinder. In the exemplary vehicle engine 10 depicted, which is a V8 engine, each exhaust manifold includes a first, second, third and fourth branch 36, 38, 40, 42. The first branch 36 extends between the mounting flange 24 and the collector 16. Each of the second, third and fourth branches 38, 40, 42, also extend from the mounting flange 24 to the collector 16. The mounting flange 24 abuts the vehicle engine 10 to place the first, second, third and fourth branches 36, 38, 40, 42 of the exhaust manifold 14 in fluid communication with the bank of cylinders (not shown) of the vehicle engine 10. In some configurations, the first branch 36, and the second branch 38 may be joined in fluid communication with one another upstream of the collector inlet 30. The third branch 40 and the fourth branch 42 may also be joined together in fluid communication with one another upstream of the collector inlet 30. Regardless, all cylinders of the representative cylinder bank are in fluid communication with one another inside the collector 16. The opposite bank of cylinders is equipped with another exhaust manifold 14 that is substantially a mirror image of the previously described exhaust manifold 14.

The exhaust conduit 18 is positioned downstream from the collector 16 and receives gas exiting the collector 16. The exhaust conduit 18 extends between the collector outlet 32 and the muffler assembly 20. The exhaust conduit 18 may include a catalytic converter 44, one or more flexible bellows 46, and/or additional connecting pipes 48. If the vehicle is so equipped, the catalytic converter 44 treats exhaust gases and the flexible bellow 46 absorbs movements in the exhaust system 12. Gas exiting the exhaust conduit 18 is provided to the muffler assembly 20.

The muffler assembly 20 may be shaped to fit within a given available space on a vehicle (not shown). For example, in some configurations, the muffler assembly 20 may be shaped to fit around a spare tire well of the vehicle and/or other components at or near an undercarriage of the vehicle.

The muffler assembly includes a housing 50, a primary pipe 52 extending through at least one wall 54 of the housing 50, a secondary pipe 56 extending through at least one wall 54 of the housing 50, and a valve 58. The primary pipe 52 may extend through the housing 50 between a primary pipe inlet 60 and a primary pipe outlet 62. The primary pipe inlet 60 is in fluid communication with the collector 16, via the exhaust conduit 18. In other words, the primary pipe inlet 60 receives exhaust gas from the exhaust conduit 18. The valve 58 is operable to restrict exhaust gas flow through the primary pipe 52. The valve 58 may be an electrically operated valve and have a range of operating positions from a full open position to a full closed position. The exact position of the valve 58 is dependent on the desired performance characteristics of the muffler assembly 20. A full open position of the valve 58 allows exhaust gas to freely pass through the primary pipe 52 and exit the primary pipe outlet 62. A full closed position of the valve 58 restricts the flow of exhaust gas through the primary pipe outlet 62 and redirects exhaust gas flow through the muffler assembly 20. In the configuration shown in the figures, the valve 58 is positioned downstream and outside of the housing 50. Alternatively, the valve 58 may be positioned inside of the housing 50.

The figures depict a closed-closed system which is defined when the primary pipe outlet 62 is closed via the valve 58. More specifically, a closed-closed system may be present when the valve 58 is in the full closed position at one end of the system and the exhaust manifold 14 is disposed at the opposite end of the system. A standing wave may be developed in a closed-closed system when two waves move in opposite directions. The standing wave may extend from the collector outlet 32 to the valve 58. A resonance length 66 is defined as the distance from the collector outlet 32 to the valve 58 along the centerline of the exhaust conduit 18 and the primary pipe 52. The standing wave may result in an audible frequency that displeases customers. Thus, there is a need to attenuate, eliminate or otherwise reduce and minimize the standing wave.

Figure 3:
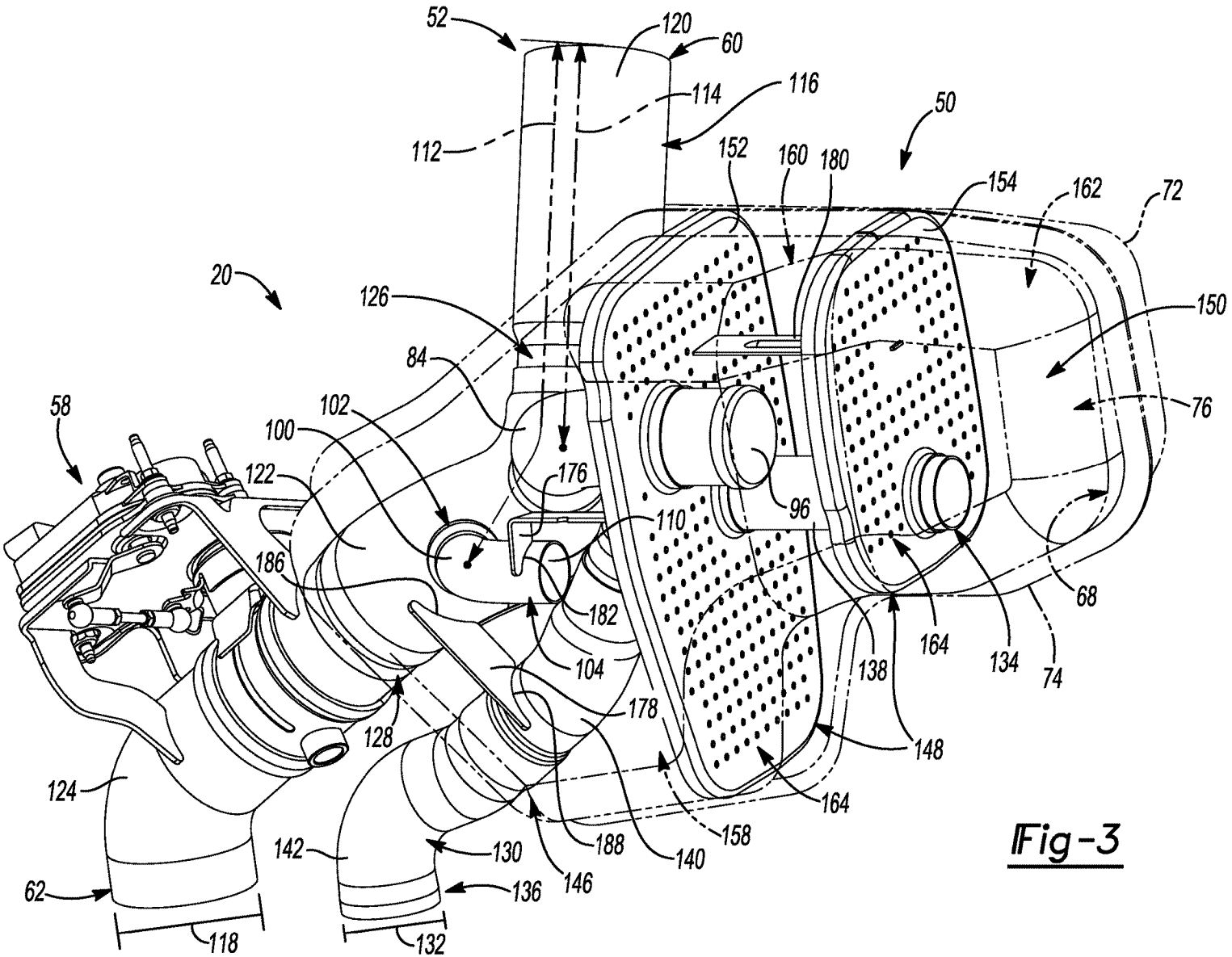
FIG. 3 is a perspective view of the exemplary muffler assembly shown in FIG. 2, where the housing is transparent.
Figure 4:
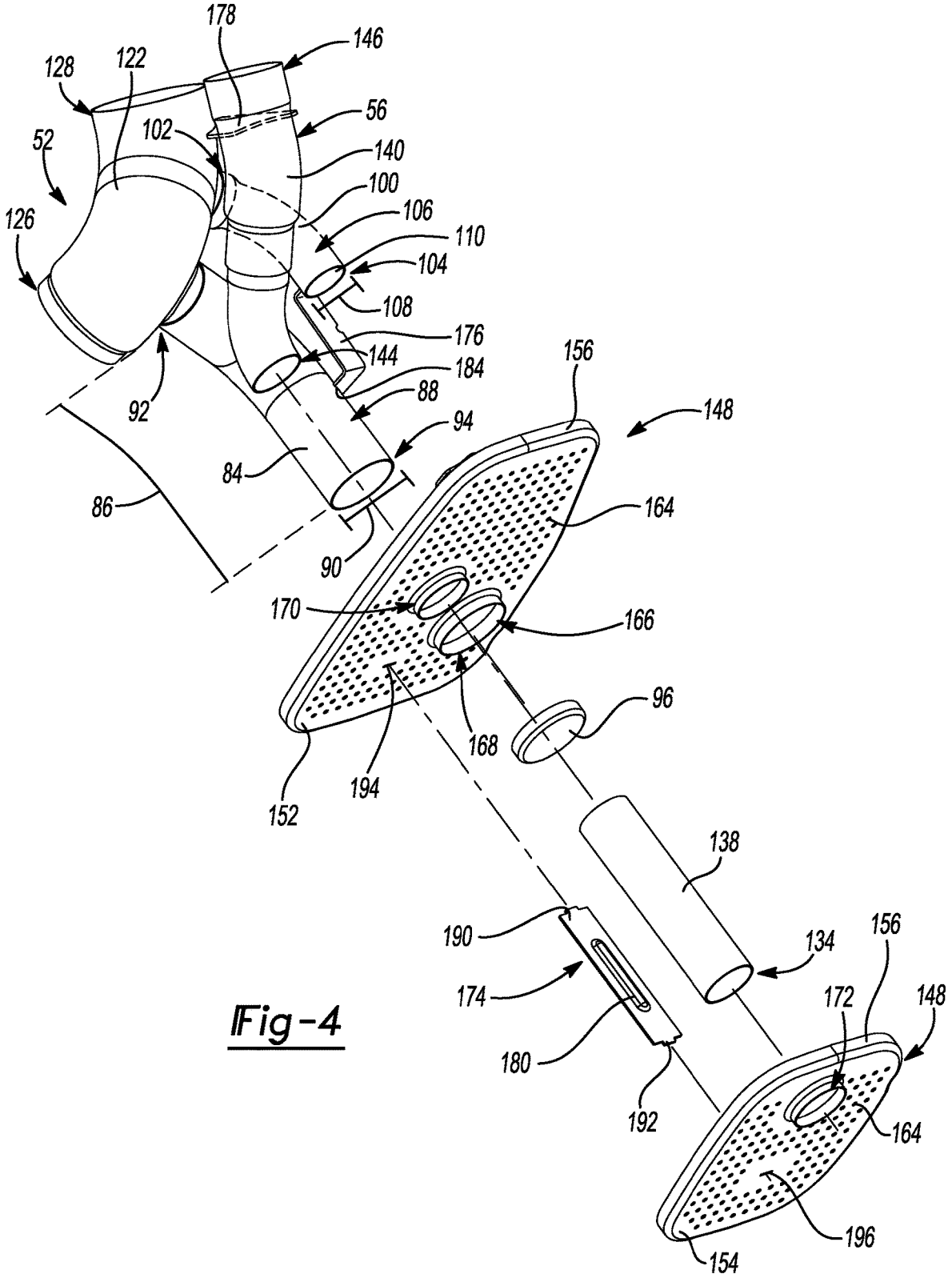
FIG. 4 is an exploded perspective view of the exemplary muffler assembly shown in FIGS. 2 and 3, where portions of the primary and secondary pipes are removed and the housing is removed.

With reference to FIGS. 2 to 4, the muffler assembly 20 is operable to reduce noise and tune the exhaust sound characteristics to desired sound qualities. In the configuration shown in the figures, the housing 50 includes an inner housing surface 68, an outer housing surface 70, a first shell 72 and a second shell 74. The first shell 72 may be welded, mechanically locked, or otherwise sealingly fixed to the second shell 74 to define an enclosed volume 76. Additionally, the housing 50 may include an inlet opening 78, a first outlet opening 80 and a second outlet opening 82. A one-piece housing is also contemplated.

The muffler assembly includes a tuner tube 84. The tuner tube 84 has a tuner tube length 86 substantially one-quarter of the resonance length 66. In this instance, "substantially one-quarter" refers to a length that need not be exactly one-quarter of the resonance length 66 but within a tolerance of plus or minus 5% of the resonance length 66. The tuner tube 84 has an outer tuner tube surface 88 and a tuner tube diameter 90.

The tuner tube 84 extends between an open tuner tube end 92 and a closed tuner tube end 94. The tuner tube 84 may include one or more bends or curves. The open tuner tube end 92 is open into the primary pipe 52 and allows for fluid communication between the tuner tube 84 and the primary pipe 52. The closed tuner tube end 94 is sealed by a tube cap 96. The tuner tube 84 is operable to attenuate the standing wave. The optimal position of the open tuner tube end 92 is at a high acoustic pressure position within the exhaust system 12. More specifically, the position of the open tuner tube end 92 is optimal when spaced from the valve 58 at a distance of about 0% to about 10% of the resonance length 66. Alternatively, the position of the open tuner tube end 92 is optimal when spaced from the collector outlet 32 at a distance of about 0% to about 10% of the resonance length 66.

The muffler assembly 20 may also include a bleed tube 100. The bleed tube 100 extends between a first bleed tube end 102 and a second bleed tube end 104. The bleed tube 100 may include one or more bends or curves. The bleed tube has an outer bleed tube surface 106 and a bleed tube diameter 108.

The first bleed tube end 102 is open into the primary pipe 52 and allows for fluid communication between the primary pipe 52 and bleed tube 100. The second bleed tube end 104 defines a bleed port 110 such that the second bleed tube end 104 is in fluid communication with the enclosed volume 76. The first bleed tube end 102 is positioned downstream from the open tuner tube end 92. A first distance 112 is defined between the primary pipe inlet 60 and the first bleed tube end 102. A second distance 114 is defined between the primary pipe inlet 60 and the open tuner tube end 92. The bleed tube 100 is positioned downstream from the open tuner tube end 92 when the first distance 112 is greater than the second distance 114. In other words, the tuner tube 84 is positioned upstream from the bleed tube 100.

The primary pipe 52 has an outer primary pipe surface 116 and a primary pipe diameter 118. The primary pipe 52 may include one or more bends or curves. In the configuration shown, the primary pipe 52 may include a primary inlet pipe 120, a primary connection pipe 122, and a primary outlet pipe 124. The primary connection pipe 122 may extend between a first connection end 126 and a second connection end 128. The primary inlet pipe 120 may be positioned outside of the housing 50 and fluidly coupled with the first connection end 126 of the primary connection pipe 122 at the inlet opening 78 of the housing 50. The primary connection pipe 122 may be disposed within the enclosed volume 76. The primary outlet pipe 124 may be positioned outside of the housing 50 and fluidly coupled to the second connection end 128 of the primary connection pipe 122 at the first outlet opening 80 of the housing 50. Gas may enter the housing 50 from the exhaust conduit 18 via the primary inlet pipe 120, flow through the housing 50 via the primary connection pipe 122, and exit the housing 50 via the primary outlet pipe 124. The primary outlet pipe 124 may be open to the ambient environment surrounding the muffler assembly 20, or may be coupled to another exhaust system component outside of the muffler assembly 20 such as a tailpipe (not shown).

The secondary pipe 56 has an outer secondary pipe surface 130 and a secondary pipe diameter 132. The secondary pipe 56 may extend between a secondary pipe inlet 134 and a secondary pipe outlet 136. The secondary pipe inlet 134 is open to and in fluid communication with the enclosed volume 76 and the secondary pipe outlet 136 is positioned outside of the housing 50. The secondary pipe 56 may include one or more bends or curves. The secondary pipe 56 may include a secondary inlet pipe 138, a secondary communication pipe 140, and a secondary outlet pipe 142. The secondary communication pipe 140 may extend between a third connection end 144 and a fourth connection end 146. The third connection end 144 of the secondary communication pipe 140 may be fluidly coupled to the secondary inlet pipe 138. The fourth connection end 146 of the secondary communication pipe 140 may be fluidly coupled to the secondary outlet pipe 142 at the second outlet opening 82. The secondary outlet pipe 142 may be open to the ambient environment surrounding the muffler assembly 20, or may be coupled to another exhaust system component outside of the muffler assembly 20 such as a tailpipe (not shown).

The shapes and diameters of the pipes may be tailored to achieve a desired range of sounds and desired performance characteristics over a given range of engine speeds. For instance, the embodiment shown in FIGS. 2 to 4 depicts the tuner tube diameter 90 as being greater than the bleed tube diameter 108. Additionally, the primary pipe diameter 118 is greater than the tuner tube diameter 90, the bleed tube diameter 108, and the secondary pipe diameter 132. Because of the difference between the primary pipe diameter 118 and bleed tube diameter 108, a greater flow rate of exhaust gas may be emitted from the primary pipe outlet 62 versus traveling into the enclosed volume 76 via the bleed tube 100 when the valve 58 is open.

The muffler assembly 20 may have a baffle 148 disposed within the enclosed volume 76 and cooperating with the housing 50 to define one or more chambers 150 within the enclosed volume 76. The number of baffles, number of chambers, and/or volume of the chambers may not influence the performance of the tuner tube 84. Rather, the number and placement of the one or more baffles 148 may be dependent on the mechanical support required by the housing 50 and/or the desired performance characteristics of the muffler assembly 20. As shown in FIGS. 3 and 4, a first baffle 152 and a second baffle 154 are disposed within the enclosed volume 76. The second baffle 154 is spaced apart from the first baffle 152. Each of the first and second baffle 152, 154 may include an outer periphery 156, which is shaped to generally match the contours of the inner housing surface 68. The outer periphery 156 may be welded, mechanically locked, or otherwise sealingly fixed to the inner housing surface 68.

The first and second baffles 152, 154 may divide the enclosed volume 76 into a first chamber 158, a second chamber 160, and a third chamber 162. The first chamber 158 may be defined by the first baffle 152, the first shell 72, and the second shell 74. The second chamber 160 may be defined by the first baffle 152, the second baffle 154, the first shell 72 and the second shell 74. The third chamber 162 may be defined by the second baffle 154, the first shell 72, and the second shell 74. Therefore, the second chamber 160 may be positioned between the first and third chambers 158, 162.

Each of the first and second baffles 152, 154 may include one or more perforations 164 to allow fluid communication among adjacent chambers. The number and placement of the one or more perforations 164 may be dependent on the desired performance of the muffler assembly 20. A greater number of perforations allow for a more fluid flow of gases between adjacent chambers, whereas a reduced number of perforations has the ability to restrict flow of gases between the adjacent chambers. In the configuration shown in FIGS. 3 and 4, the first and second baffles 152, 154 contain a plurality of the perforations 164. The perforations 164 in the first baffle 152 allow for fluid communication between the first and second chambers 158, 160. The perforations 164 in the second baffle 154 allow for fluid communication between the second and third chambers 160, 162. Additionally, each of the first and second baffles 152, 154 may include one or more baffle openings 166 for pipes to extend through the first, second and third chambers 158, 160, 162. The one or more baffle openings 166 are coupled to the respective pipes and may not allow for fluid communication of the enclosed volume 76 between adjacent chambers. The first baffle 152 may include a first and second baffle opening 168, 170. The second baffle 154 may include a third baffle opening 172.

The primary pipe 52 and bleed tube 100 may be positioned within the first chamber 158. The tuner tube 84 may extend from the first chamber 158, through the first baffle 152 via the first baffle opening 168, and into the second chamber 160. Thus, the open tuner tube end 92 may be positioned within the first chamber 158 and the closed tuner tube end 94 may be positioned within the second chamber 160. Next, the bleed tube 100 may be positioned within the first chamber 158. Lastly, the secondary pipe 56 may extend through the second baffle 154 between the third chamber 162 and the second chamber 160 via the third baffle opening 172 and through the first baffle 152 between the second chamber 160 and first chamber 158 via the second baffle opening 170. Thus, the secondary pipe inlet 134 may be open to and in fluid communication with the third chamber 162.

One or more brackets 174 may be disposed within the housing 50 to provide additional support between components. In the configurations shown in the figures, a first bracket 176, a second bracket 178, and a third bracket 180 is provided. The first bracket 176 may be disposed within the first chamber 158 and extends between a first bracket end 182 and a second bracket end 184. The first bracket end 182 may be contoured to the general shape of the outer bleed tube surface 106 and abuts the outer bleed tube surface 106. The second bracket end 184 may be contoured to the general shape of the outer tuner tube surface 88 and abuts the outer tuner tube surface 88. The second bracket 178 may also disposed within the first chamber 158 and extend between a third bracket end 186 and a fourth bracket end 188. The third bracket end 186 may be contoured to the general shape of the outer primary pipe surface 116. The fourth bracket end 188 may be contoured to the general shape of the outer secondary pipe surface 130. The third bracket end 186 abuts the outer primary pipe surface 116 and the fourth bracket end 188 abuts the outer secondary pipe surface 130. Lastly, the third bracket 180 may be disposed within the second chamber 160. The third bracket 180 extends between a fifth bracket end 190 and a sixth bracket end 192. The fifth bracket end 190 abuts a first insert 194 of the first baffle 152 and the sixth bracket end 192 abuts a second insert 196 of the second baffle 154. The first, second, third, fourth, fifth, and sixth bracket ends 182, 184, 186, 188, 190, 192 may be welded, mechanically locked, or otherwise sealingly fixed to the respective component.

Figure 5:
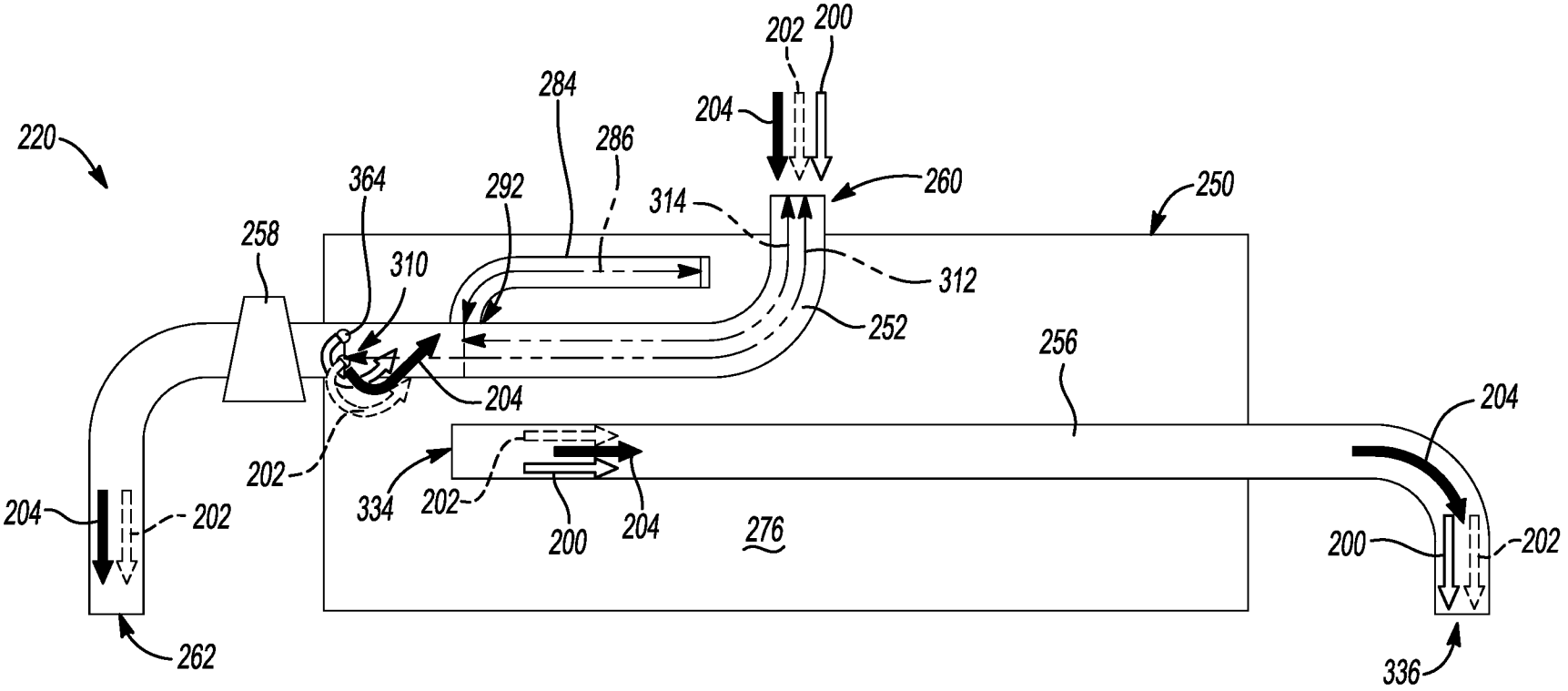
FIG. 5 is a schematic of another exemplary muffler assembly according to the principles of the present disclosure, where arrows are included to illustrate a closed valve flow path, an open valve flow path, and an intermediately open valve flow path.
Figure 6:
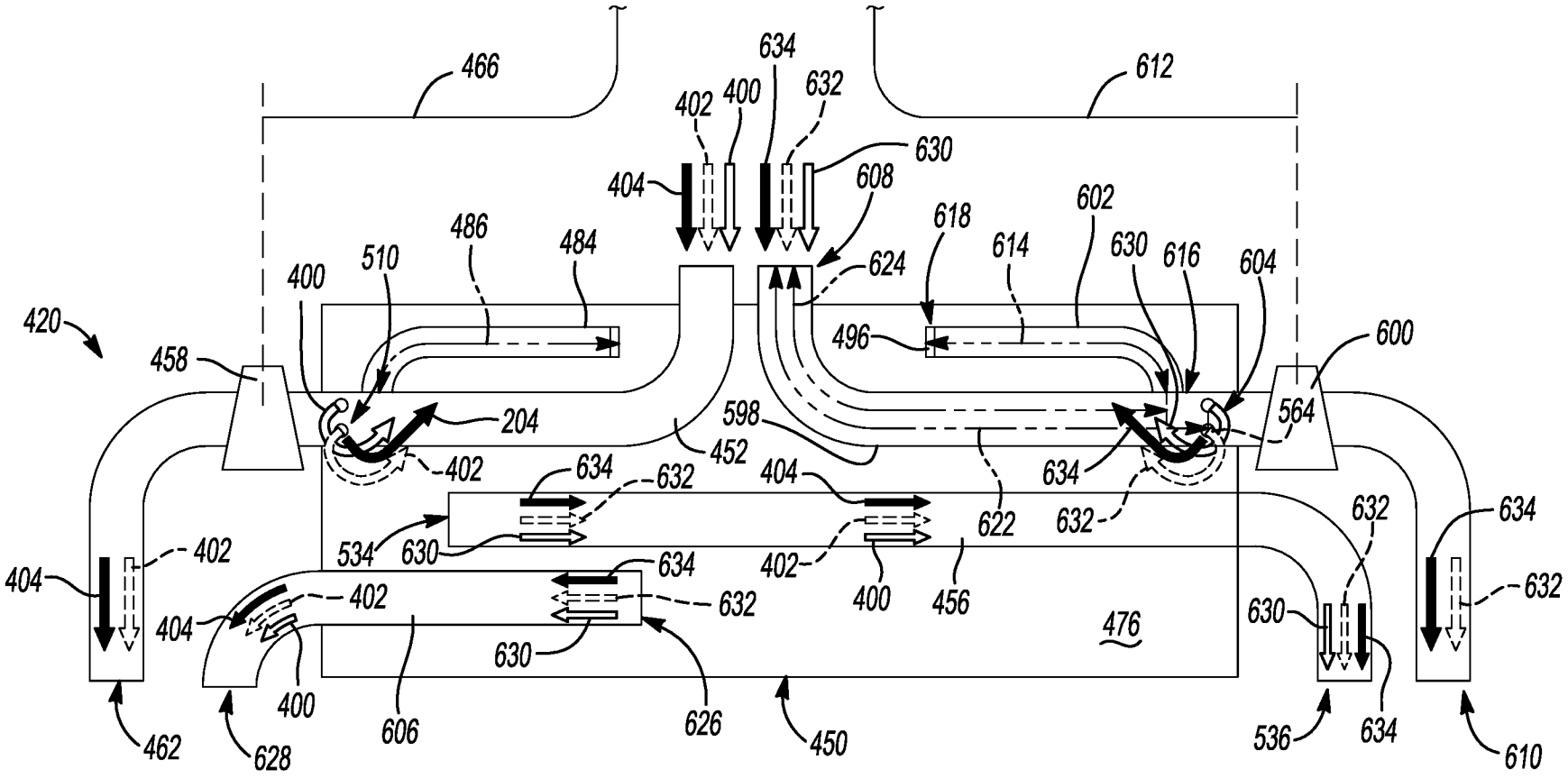
FIG. 6 is a schematic of yet another exemplary muffler assembly according to the principles of the present disclosure, where additional arrows are included to illustrate a closed valve flow path, an open valve flow path, an intermediately open valve flow path, a second closed valve flow path, a second open valve flow path, and a second intermediately open valve flow path.

As shown in FIGS. 5 and 6, the muffler assembly of the present disclosure may be constructed in a number of different ways. Many of the elements of the muffler assembly 20 previously described are the same or substantially the same amongst the multiple embodiments. More specifically, the structure, position, and function of these components may be similar or identical to that of the corresponding components of the muffler assembly 20 described above. Therefore, the common components are not described again in detail. Equivalent elements shared between the embodiments have corresponding reference numbers. For example, reference number 50 in FIGS. 2 to 4 corresponds to reference number 250 in FIGS. 5 and 450 in FIG. 6. Additionally, reference number 110 in FIGS. 2 to 4 corresponds to reference number 310 in FIG. 5 and reference number 510 in FIG. 6.

Referring now to FIG. 5, another muffler assembly 220 is provided. Like the muffler assembly 20 of the previous embodiment, the muffler assembly 220 includes a housing 250, a primary pipe 252, a valve 258, a tuner tube 284 with a tuner tube length 286, and a secondary pipe 256.

The shapes of the pipes may be tailored to achieve a desired range of sounds and desired performance characteristics over a given range of engine speeds. In the configuration shown, the primary pipe outlet 262 and secondary pipe outlet 336 are positioned at opposite ends of the housing 250.

A bleed port 310 is formed in the primary pipe 252 as at least one perforation 364. In the configuration shown, a plurality of perforations 364 are disposed through the primary pipe 252 and positioned circumferentially. The bleed port 310 is open to and in fluid communication with the enclosed volume 276 via the perforations 364. The bleed port 310 is positioned downstream from the open tuner tube end 292. A first distance 312 is defined as the distance between the primary pipe inlet 260 and the bleed port 310. A second distance 314 is defined between the primary pipe inlet 260 and the open tuner tube end 292. The bleed port 310 is positioned downstream from the open tuner tube end 292 when the first distance 312 is greater than the second distance 314. In other words, the open tuner tube end 292 is positioned upstream from the bleed port 310.

A closed valve flow path 200 is defined when the valve 258 is in the full closed position. In the closed valve flow path 200, gas from the exhaust conduit 18 enters the primary pipe 252 of the muffler assembly 220 via the primary pipe inlet 260. Gas from the primary pipe inlet 260 flows to the bleed port 310 for entry into the enclosed volume 276. Meanwhile, sound waves may travel to the tuner tube 284 for attenuating the standing wave. Gas from the enclosed volume 276 flows into the secondary pipe 256 via the secondary pipe inlet 334. Gas from the secondary pipe inlet 334 travels to the secondary pipe outlet 336 for emission.

An open valve flow path 202 and also intermediately open valve flow path 204 are defined when the valve 258 is in the full open position or partially open position, respectively. In the open and intermediately open valve flow paths 202, 204, exhaust gas from the exhaust conduit 18 enters the primary pipe 252 via the primary pipe inlet 260. Exhaust gas from the primary pipe inlet 260 flows to the primary pipe outlet 262 for emission. Meanwhile, exhaust gas from the primary pipe inlet 260 flows to the bleed port 310 for entry into the enclosed volume 276. Gas from the enclosed volume 276 flows into the secondary pipe 256 via the secondary pipe inlet 334. Gas from the secondary pipe inlet 334 flows to the secondary pipe outlet 336 for emission.

Referring now to FIG. 6, another muffler assembly 420 is provided. Like the muffler assemblies 20, 220 of the previous embodiments, the muffler assembly 420 includes a housing 450, a primary pipe 452, a valve 458, a tuner tube 484 with a tuner tube length 486, a bleed port 510, and a secondary pipe 456 with a closed valve flow path 400, an open valve flow path 402, and an intermediately open valve flow path 404. Like the tuner tubes 84, 284 of the previous embodiments, the tuner tube 484 has a tuner tube length 486 of substantially one-quarter of the resonance length 466. In this instance, "substantially one-quarter" refers to a length that need not be exactly one-quarter of the resonance length 466 but within a tolerance of plus or minus 5% of the resonance length 466.

The muffler assembly 420 further includes a tertiary pipe 598, a second valve 600, a second tuner tube 602, a second bleed port 604, and a quaternary pipe 606. The tertiary pipe 598 may extend through the housing 450 between a tertiary pipe inlet 608 and a tertiary pipe outlet 610. The tertiary pipe inlet 608 is in fluid communication with the collector 16 via the exhaust conduit 18. In other words, the tertiary pipe inlet 608 receives gas from the exhaust conduit 18. The second valve 600 is operable to restrict flow through the tertiary pipe 598. A full open position of the second valve 600 allows gas to freely pass through the tertiary pipe 598 and exit the tertiary pipe outlet 610. A full closed position of the second valve 600 redirects gas through the enclosed volume 476 of the housing 450 and restricts emission of gas through the tertiary pipe outlet 610. In the configuration shown in the figures, the second valve 600 is positioned downstream and outside of the housing 450. Alternatively, the second valve 600 may be positioned inside of the housing 450.

A closed-closed system is defined when both tertiary pipe outlet 610 and collector outlet 32 are in a closed state. More specifically, a closed-closed system may be present when the second valve 600 is in the full closed position at one end of the system and the exhaust manifold 14 is disposed at the opposite end of the system. A standing wave may extend from the collector outlet 32 to the second valve 600 and define a second resonance length 612 measured from the collector outlet 32 to the second valve 600 along the centerline of the exhaust conduit 18 and tertiary pipe 598.

The second tuner tube 602 has a second tuner tube length 614 of substantially one-quarter of the second resonance length 612. In this instance, "substantially one-quarter" refers to a length that need not be exactly one-quarter of the second resonance length 612 but within a tolerance of plus or minus 5% of the second resonance length 612. The second tuner tube 602 extends between an open second tuner tube end 616 and a closed second tuner tube end 618. The open second tuner tube end 616 allows for fluid communication between the second tuner tube 602 and tertiary pipe 598. The closed second tuner tube end 618 is sealed by the tube cap 496. The second tuner tube 602 is operable to attenuate the standing wave. The optimal position of the second tuner tube 602 is where there is high acoustic pressure within the exhaust system. More specifically, the position of the open second tuner tube end 616 is optimal when spaced from the second valve 600 at another distance of about 0% to about 10% of the second resonance length 612. Alternatively, the position of the open second tuner tube end 616 is optimal when spaced from the collector outlet 32 at another distance of about 0% to about 10% of the second resonance length 612 (not shown).

The second bleed port 604 may include a plurality of perforations 564 that are disposed through the tertiary pipe 598 and positioned circumferentially. The second bleed port 604 is open to and in fluid communication with the enclosed volume 476 via the perforations 564. The second bleed port 604 must be positioned downstream from the open second tuner tube end 616. A third distance 622 is defined between the tertiary pipe inlet 608 and the second bleed port 604. A fourth distance 624 is defined between the tertiary pipe inlet 608 and the open second tuner tube end 616. The second bleed port 604 is positioned downstream from the open second tuner tube end 616 when the third distance 622 is greater than the fourth distance 624. In other words, the open second tuner tube end 616 is positioned upstream from the second bleed port 604.

The quaternary pipe 606 extends between a quaternary pipe inlet 626 and a quaternary pipe outlet 628. The quaternary pipe inlet 626 is open to and in fluid communication with enclosed volume 476 and the quaternary pipe outlet 628 is positioned outside of the housing 450. The quaternary pipe outlet 628 may be open to the ambient environment surrounding the muffler assembly 420, or may be coupled to another exhaust system component outside of the muffler assembly 420 such as a tailpipe (not shown).

The shapes of the pipes may be tailored to achieve a desired range of sounds and desired performance characteristics over a given range of engine speeds. In the configuration shown, the tertiary pipe outlet 610 and secondary pipe outlet 536 is positioned on the same end of the housing 450. The primary pipe outlet 462 and quaternary pipe outlet 628 is positioned on the same end of the housing 450. The primary pipe outlet 462 and the tertiary pipe outlet 610 is positioned on opposite ends of the housing 450. Similarly, the secondary pipe outlet 536 and quaternary pipe outlet 628 is positioned on opposite ends of the housing 450.

A second closed valve flow path 630 is defined when the second valve 600 is in the full closed position. In the second closed valve flow path 630, gas from the exhaust conduit 18 enters the tertiary pipe 598 via the tertiary pipe inlet 608. Gas from the tertiary pipe inlet 608 flows to the second bleed port 604 for entry into the enclosed volume 476. Meanwhile, sound waves may travel to the second tuner tube 602 for attenuating the standing wave. Gas from the enclosed volume 476 flows into the secondary pipe 456 via the secondary pipe inlet 534 and into the quaternary pipe 606 via the quaternary pipe inlet 626. Gas from the secondary pipe inlet 534 flows to the secondary pipe outlet 536 for emission and gas from the quaternary pipe inlet 626 flows to the quaternary pipe outlet 628 for emission.

A second open valve flow path 632 and also a second intermediately open valve flow path 634 are defined when the second valve 600 is in the full open position or partially open position, respectively. In the second open valve flow path 632 and second intermediately open valve flow path 634, gas from the exhaust conduit 18 enters the tertiary pipe 598 via the tertiary pipe inlet 608. Gas from the tertiary pipe inlet 608 flows to the tertiary pipe outlet 610 for emission. Gas from the tertiary pipe inlet 608 also flows to the second bleed port 604 for entry into the enclosed volume 476. Gas from the enclosed volume 476 flows into the secondary pipe 456 via the secondary pipe inlet 534 and into the quaternary pipe 606 via the quaternary pipe inlet 626. Gas from the secondary pipe inlet 534 flows to the secondary pipe outlet 536 for emission and gas from the quaternary pipe inlet 626 flows to the quaternary pipe outlet 628 for emission.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A muffler assembly for an exhaust system of a vehicle engine emitting exhaust gas, and the exhaust system including a collector and an exhaust conduit providing exhaust gas to the muffler assembly, the muffler assembly comprising:

a housing defining an enclosed volume;

a primary pipe including a primary pipe inlet and a primary pipe outlet, the primary pipe extending through the enclosed volume:

a valve operable to restrict flow through the primary pipe;

a resonance length configured to be defined by a length of the exhaust system that extends from the collector to the valve;

a secondary pipe including a secondary pipe inlet positioned in fluid communication with the enclosed volume and a secondary pipe outlet positioned outside of the enclosed volume;

a tuner tube including an open tuner tube end in fluid communication with the primary pipe and a closed tuner tube end that is opposite the open tuner tube end, the tuner tube having a tuner tube length substantially one-quarter of the resonance length;

a bleed port formed in the primary pipe and in fluid communication with the enclosed volume, the bleed port being positioned downstream from the open tuner tube end;

a first baffle cooperating with the housing to define a first chamber;

a second baffle cooperating with the housing to define a third chamber;

a second chamber positioned between the first and second baffles; and each of the first and second baffles including at least one perforation allowing the second chamber to be in fluid communication with the first chamber and the third chamber.

2. The muffler assembly of claim 1, wherein the tuner tube is positioned within the first and second chambers.

3. The muffler assembly of claim 1, wherein the bleed port is positioned within the first chamber.

4. The muffler assembly of claim 1, wherein the secondary pipe inlet is positioned within the third chamber.

5. The muffler assembly of claim 1, wherein the open tuner tube end is positioned in the first chamber and the closed tuner tube end is positioned in the second chamber.

6. The muffler assembly of claim 1, wherein the valve is positioned within the enclosed volume.

7. The muffler assembly of claim 1, wherein the valve is positioned outside of the enclosed volume.

8. A muffler assembly for an exhaust system of a vehicle engine emitting exhaust gas, and the exhaust system including a collector and an exhaust conduit providing exhaust gas to the muffler assembly, the muffler assembly comprising:

a housing defining an enclosed volume;

a primary pipe including a primary pipe inlet and a primary pipe outlet, the primary pipe extending through the enclosed volume;

a valve operable to restrict flow through the primary pipe;

a resonance length configured to be defined by a length of the exhaust system that extends from the collector to the valve;

a secondary pipe including a secondary pipe inlet positioned in fluid communication with the enclosed volume and a secondary pipe outlet positioned outside of the enclosed volume;

a tuner tube including an open tuner tube end in fluid communication with the primary pipe and a closed tuner tube end that is opposite the open tuner tube end, the tuner tube having a tuner tube length substantially one-quarter of the resonance length;

a bleed port formed in the primary pipe and in fluid communication with the enclosed volume, the bleed port being positioned downstream from the open tuner tube end; and a bleed tube including a first bleed tube end in fluid communication with the primary pipe and a second bleed tube end, wherein the bleed port is disposed at the second bleed tube end.

9. The muffler assembly of claim 8, wherein the bleed port is at least one perforation.

10. A muffler assembly for an exhaust system for a vehicle engine emitting exhaust gas, and the exhaust system including a collector and an exhaust conduit providing exhaust gas to the muffler assembly, the muffler assembly comprising:

a housing defining an enclosed volume;

a primary pipe including a primary pipe inlet and a primary pipe outlet, the primary pipe extending through the enclosed volume;

a first valve operable to restrict flow through the primary pipe;

a first resonance length defined by a length of the exhaust system that extends from the collector to the valve;

a secondary pipe including a secondary pipe inlet positioned in fluid communication with the enclosed volume and a secondary pipe outlet positioned outside of the enclosed volume;

a tertiary pipe including a tertiary pipe inlet and a tertiary pipe outlet, the tertiary pipe extending through the enclosed volume;

a first tuner tube including an open first tuner tube end in fluid communication with the primary pipe and a closed first tuner tube end that is opposite the open first tuner tube end, the first tuner tube having a first tuner tube length of substantially one-quarter of the first resonance length;

a first bleed port formed in the primary pipe in fluid communication with the enclosed volume, the first bleed port being positioned downstream from the open first tuner tube end;

a second valve operable to restrict flow through the tertiary pipe;

a second resonance length defined by a length of the exhaust system that extends from the collector to the second valve;

a second tuner tube including an open second tuner tube end in fluid communication with the tertiary pipe and a closed second tuner tube end that is opposite the open second tuner tube end, the second tuner tube having a second tuner tube length of substantially one-quarter of the second resonance length; and a second bleed port formed in the tertiary pipe tube in fluid communication with the enclosed volume, the second bleed port being positioned downstream from the open second tuner tube end.

11. The muffler assembly of claim 10, further comprising:

a quaternary pipe including a quaternary pipe inlet positioned in fluid communication with the enclosed volume and a quaternary pipe outlet positioned outside of the enclosed volume.

12. The muffler assembly of claim 10, wherein the open tuner tube end is positioned in the first chamber and the closed tuner tube end is positioned in the second chamber.

13. The muffler assembly of claim 10, wherein a first distance between the primary pipe inlet and the first bleed port is greater than a second distance between the primary pipe inlet and the open first tuner tube end.

14. The muffler assembly of claim 10, further comprising:

a first baffle cooperating with the housing to define a first chamber;

a second baffle cooperating with the housing to define a third chamber;

a second chamber positioned between the first and second baffles; and each of the first and second baffles including at least one perforation allowing the second chamber to be in fluid communication with the first chamber and the third chamber.

* * * * *